US007111655B1

(12) United States Patent
Hall

(10) Patent No.: US 7,111,655 B1
(45) Date of Patent: Sep. 26, 2006

(54) ROUTER SUPPORT ASSEMBLY

(76) Inventor: Matthew E. Hall, 38045 10th St. East #14, Palmdale, CA (US) 93550

( * ) Notice: Subject to any disclaimer, the term of this patent is extended or adjusted under 35 U.S.C. 154(b) by 0 days.

(21) Appl. No.: 11/177,691

(22) Filed: Jul. 11, 2005

(51) Int. Cl.
*B25H 1/02* (2006.01)
*B25H 1/16* (2006.01)

(52) U.S. Cl. ..... 144/286.5; 144/287

(58) Field of Classification Search ..... 144/286.1–287, 144/134.1, 135.2, 135.3; 83/136.1, 477.2, 83/437.1, 468.2–468.7; 409/180, 182
See application file for complete search history.

(56) References Cited

U.S. PATENT DOCUMENTS

| | | | | |
|---|---|---|---|---|
| 4,484,608 | A | 11/1984 | Ferdinand et al. | |
| 4,763,706 | A | 8/1988 | Rice et al. | |
| 4,830,074 | A | 5/1989 | Lundblom | |
| 5,025,841 | A | 6/1991 | Trotten | |
| 5,396,937 | A | 3/1995 | Clausen | |
| 5,429,162 | A | 7/1995 | Bonnett | |
| 5,551,813 | A | 9/1996 | Bonnett | |
| 5,715,880 | A | 2/1998 | Tucker et al. | |
| D443,882 | S | 6/2001 | Daniels et al. | |
| 6,360,798 | B1 * | 3/2002 | Apolinski | 144/286.5 |
| 2002/0043296 | A1 * | 4/2002 | Daniels et al. | 144/286.5 |

* cited by examiner

*Primary Examiner*—Lowell A. Larson
*Assistant Examiner*—Shelley Self

(57) ABSTRACT

A router support assembly includes a table that has a top side, a bottom side, a first side edge, a second side edge, a front edge and a rear edge. The table has a first slot and a second slot each extending therethrough. The first slot extends between the front and rear edges and the second slot extends from the first side edge to the first slot. A first guide is attached to the table and is selectively movable along the first slot. A second guide is attached to the table and is selectively movable along the second slot. A mounting is attached to the table and supports a router a selectable distance from the top side of the table. The mounting is positioned adjacent to the first edge. A router may be attached to the mounting so that a cutting member of the router extends toward the table.

11 Claims, 3 Drawing Sheets

ROUTER SUPPORT ASSEMBLY

BACKGROUND OF THE INVENTION

1. Field of the Invention

The present invention relates to router support devices and more particularly pertains to a new router support device for supporting a router and a portion of wood at a selected position relative to each other.

2. Description of the Prior Art

The use of router support devices is known in the prior art. U.S. Pat. No. 4,484,608 describes a device router table for supporting a router. Another type of router support device is U.S. Pat. No. 4,763,706 which includes a structure adapted for supporting a router. Yet still another such device is found in U.S. Pat. No. 5,025,841 which again includes a table having a structure well suited for holding a router as it is being used for cutting a portion of wood.

While these devices fulfill their respective, particular objectives and requirements, the need remains for a device that supports a router so that it may be selectively moved upwardly or downwardly with respect to a table surface. Additionally, the device should include both x-axis and y-axis work supports for supporting a piece, which will be cut by the router, on two sides. This will ensure that the piece will remain in a selected position and orientated for being cut.

SUMMARY OF THE INVENTION

The present invention meets the needs presented above by comprising a table that has a top side, a bottom side, a first side edge, a second side edge, a front edge and a rear edge. A plurality of legs is attached to and extends downwardly from the bottom side. The table has a first slot and a second slot each extending therethrough. The first slot extends between the front and rear edges and the second slot extends from the first side edge to the first slot. A first guide is attached to the table and is selectively movable along the first slot. A second guide is attached to the table and is selectively movable along the second slot. A mounting is attached to the table and supports a router a selectable distance from the top side of the table. The mounting is positioned adjacent to the first edge. A router may be attached to the mounting so that a cutting member of the router extends toward the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
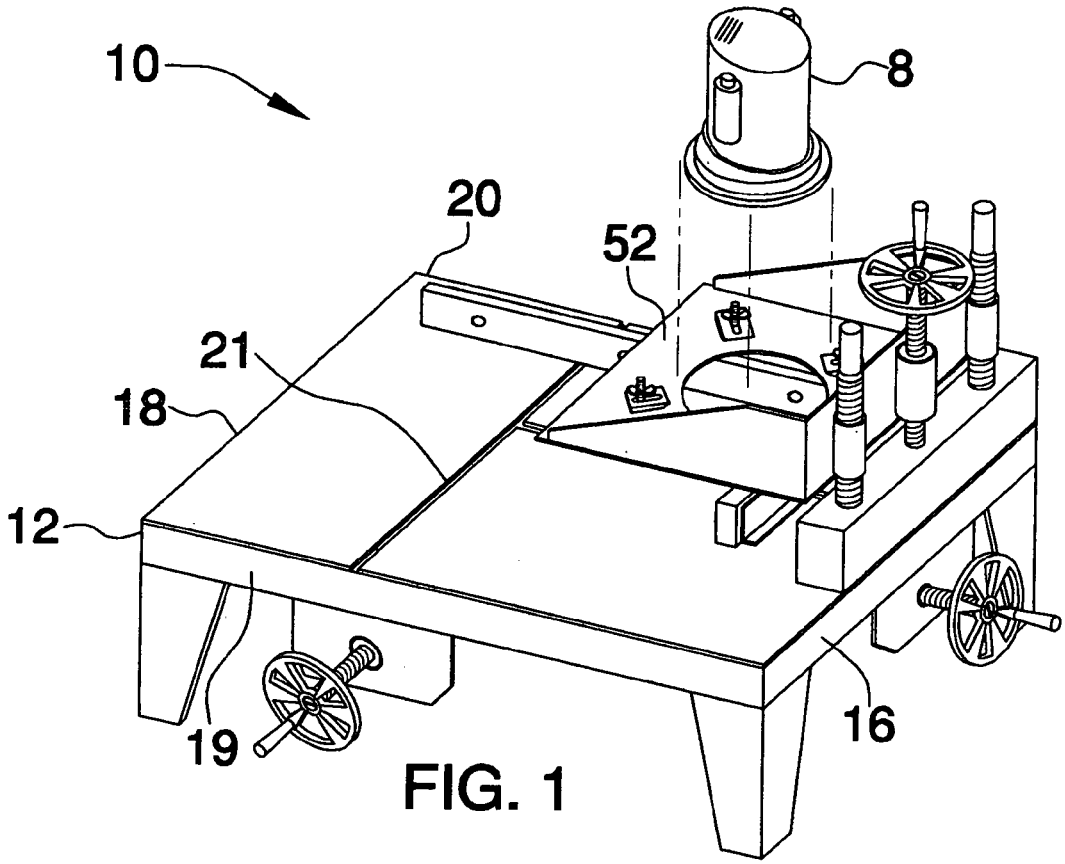
FIG. 1 is a perspective view of a router support assembly according to the present invention.
Figure 2:
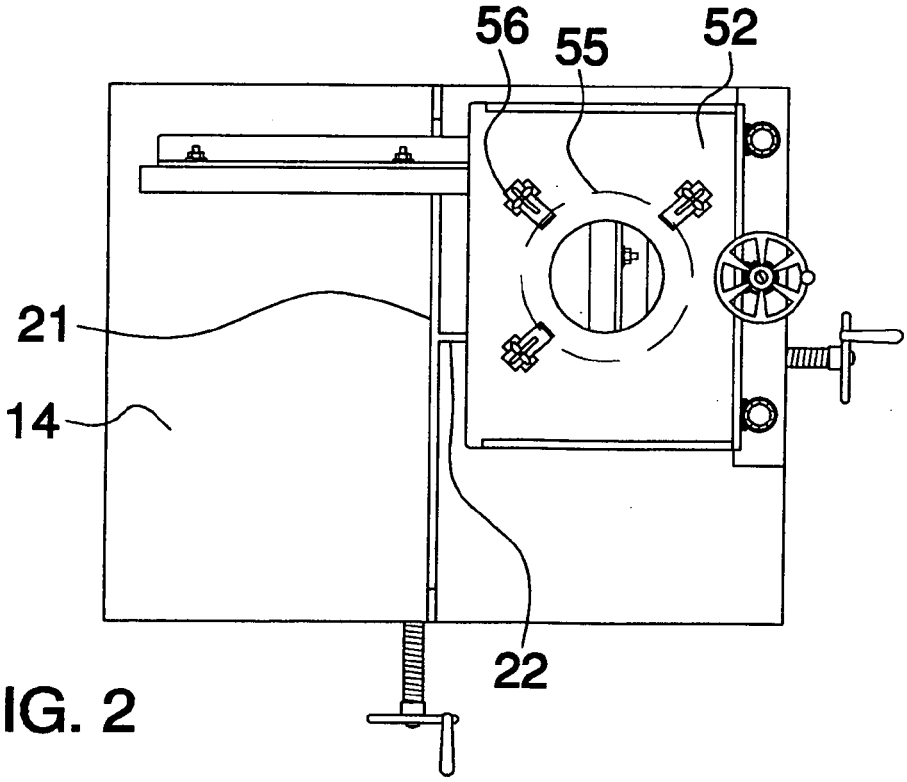
FIG. 2 is a top view of the present invention.
Figure 3:
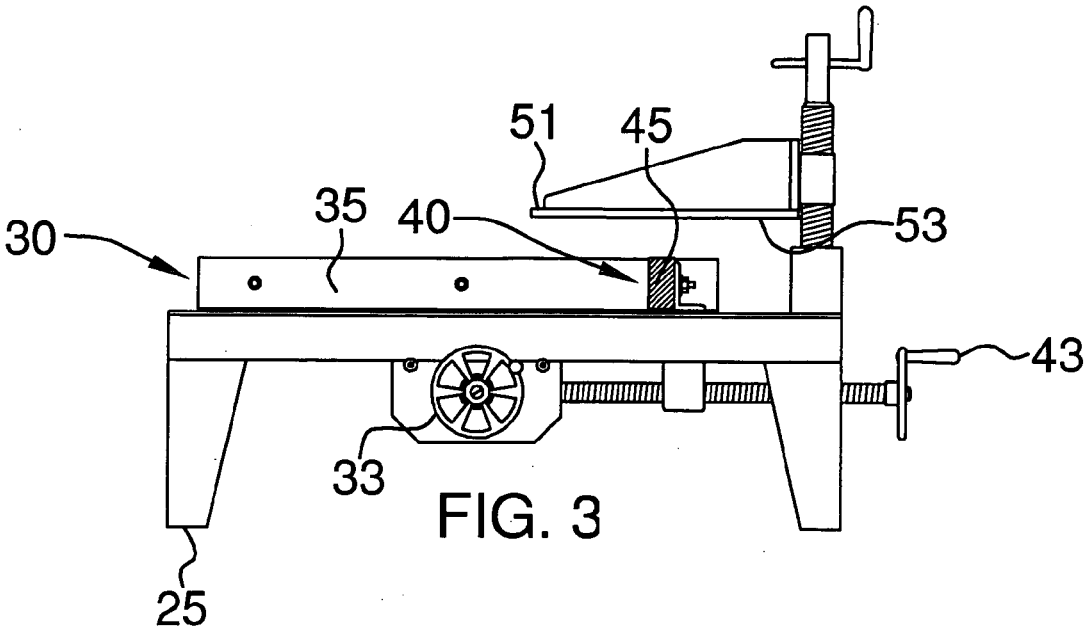
FIG. 3 is a front view of the present invention.
Figure 4:
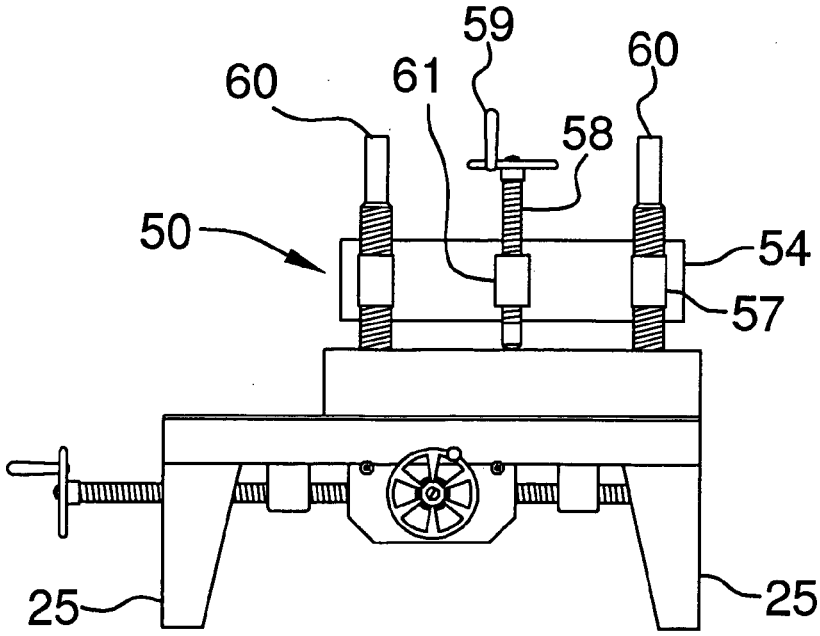
FIG. 4 is a side view of the present invention.
Figure 5:
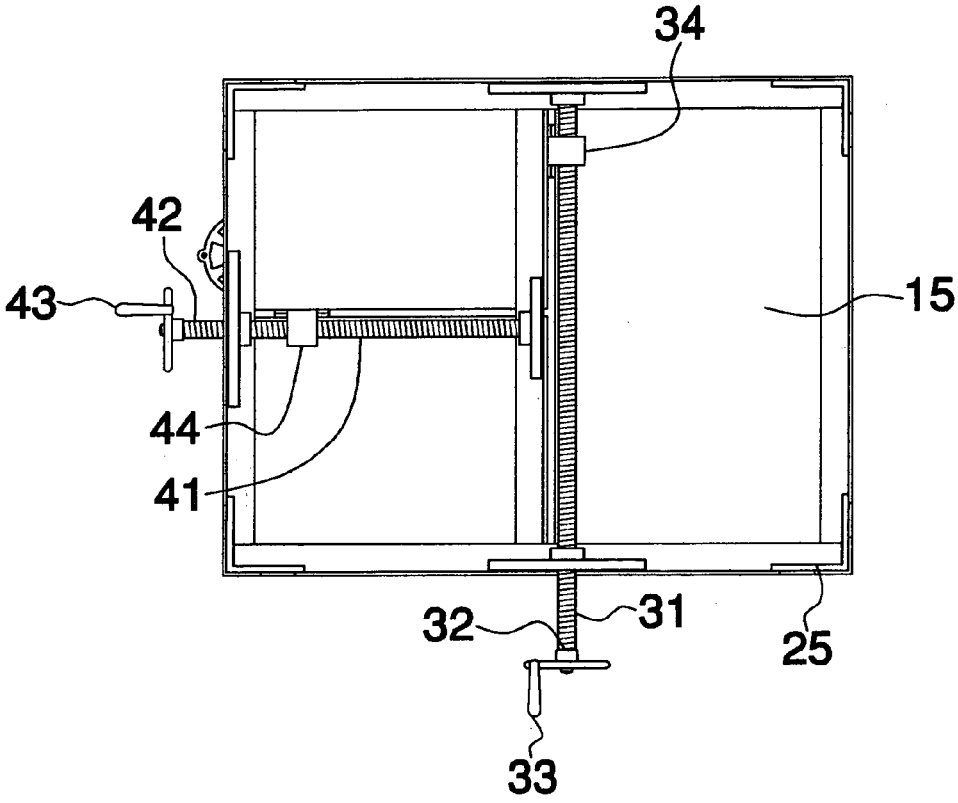
FIG. 5 is a bottom view of the present invention.

With reference now to the drawings, and in particular to FIGS. 1 through 5 thereof, a new router support device embodying the principles and concepts of the present invention and generally designated by the reference numeral 10 will be described.

As best illustrated in FIGS. 1 through 5, the router support assembly 10 generally comprises a table 12 that has a top side 14, a bottom side 15, a first side edge 16, a second side edge 18, a front edge 19 and a rear edge 20. A plurality of legs 25 is attached to and extends downwardly from the bottom side 15. The table 12 has a first slot 21 and a second slot 22 each extending therethrough. The first slot 21 extends between the front 18 and rear 19 edges and the second slot 22 extends from the first side edge 16 to the first slot 21. The first slot 21 is spaced from the first side edge 16 a distance equal to at least 8 inches. The second slot 22 is generally equally spaced from each of the front 18 and rear 19 edges.

A first guide 30 for bracing a portion of wood to be worked on is attached to the table 12 and is selectively movable along the first slot 21. The first guide includes 30 a threaded first rod 31 that is rotatably attached to the bottom side 15 and is aligned with the first slot 21. The first rod 31 has an outer end 32 extending away from the front edge 19. A first handle 33 is attached to the outer end 32 of the first rod 31. A first saddle 34 is mounted on and is threadably coupled to the first rod 31. The first saddle 34 extends upwardly through the first slot 21. The first saddle 34 moves toward the front edge 19 when the first handle 33 is rotated in a first direction and toward the rear edge 20 when the first handle 33 is rotated in a second direction. A first vertical wall 35 is attached to the first saddle 34. The first vertical wall 35 is elongated. A longitudinal axis of the first vertical wall 35 is orientated perpendicular to the first slot 21.

A second guide 40 for bracing a portion of wood is attached to the table 12 and is selectively movable along the second slot 22. The second guide 40 includes a treaded second rod 41 that is rotatably attached to the bottom side 15 and is aligned with the second slot 22. The second rod 41 has an outer end 42 extending away from the first side edge 16. A second handle 43 is attached to the outer end 43 of the second rod 42. A second saddle 44 is mounted on and threadably coupled to the second rod 41. The second saddle 44 extends upwardly through the second slot 22. The second saddle 44 moves toward the first side edge 16 when the second handle 43 is rotated in a first direction and toward the second side edge 18 when the second handle 43 is rotated in a second direction. A second vertical wall 45 is attached to the second saddle 44. The second vertical wall is elongated 45. A longitudinal axis of the second vertical wall 45 is orientated perpendicular to the second slot 22.

A mounting 50 is attached to the table 12 and supports a router 8 a selected distance from the top side 14 of the table 12. The mounting 50 is positioned adjacent to the first edge 16. The mounting 50 includes a horizontally orientated plate 51 that has an upper side 52 and a lower side 53. A lifting apparatus 54 is attached to the table 12 and supports the plate 51 above the table 12. The lifting apparatus 54 selectively lifts or lowers the plate 51 with respect to the table 12. The plate 51 has an aperture 55 extending therethrough. A plurality of couplers 56 is attached to the upper side 52 of the plate 51. The lifting apparatus 50 includes at least one post 60, and preferably two posts 60, attached to and extending upwardly from the table 12. Cylinders 57 attached to an edge of the plate 51 slidably receive the posts 60. A threaded third rod 58 is rotatably coupled to the table 12 and extends upwardly therefrom. A threaded tube 61 is attached to the edge of the plate 51 and is threadably mounted on the third rod 58. A third handle 59 is used for rotating the third rod 58 for lowering and lifting the plate 51 with respect to the table 12.

In use, a router 8 may be attached to the plate 51 with the couplers 56 so that a cutting member of the router 8 extends through the aperture 55 and toward the table 12. The first 30 and second 40 guides brace a portion of wood while it is being cut with a router 8. The mounting 50 allows the router 8 to be selectively moved upwardly or downwardly with respect to the table 12 to take into account variations in wood thickness.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A router guide and support assembly comprising:

a table having a top side, a bottom side, a first side edge, a second side edge, a front edge and a rear edge, a plurality of legs being attached to and extending downwardly from said bottom side, said table having a first slot and a second slot each extending therethrough, said first slot extending between said front and rear edges and said second slot extending from said first side edge to said first slot;

a first guide being attached to said table and being selectively movable along said first slot;

a second guide being attached to said table and being selectively movable along said second slot; and a mounting being attached to said table and supporting a router a selectable distance from said top side of said table, said mounting being positioned adjacent to said first side edge, wherein a router may be attached to said mounting such that a cutting member of said router extends downwardly toward said table.

2. The assembly according to claim 1, wherein said first slot is spaced from said first side edge a distance equal to at least 8 inches.

3. The assembly according to claim 2, wherein said second slot is generally equally spaced from each of said front and rear edges.

4. The assembly according to claim 1, further comprising:

said first guide including;

a threaded first rod being rotatably attached to said bottom side and being aligned with said first slot, said first rod having an outer end extending away from said front edge;

a first handle being attached to said outer end of said first rod;

a first saddle being mounted on and thread ably coupled to said first rod, said first saddle extending upwardly through said first slot, said first saddle moving toward said front edge when said first handle is rotated in a first direction and toward said rear edge when said first handle is rotated in a second direction;

a first vertical wall being attached to said first saddle, said first vertical wall being elongated, a longitudinal axis of said first vertical wall being orientated perpendicular to said first slot;

said second guide including;

a threaded second rod being rotatably attached to said bottom side and being aligned with said second slot, said second rod having an outer end extending away from said first side edge;

a second handle being attached to said outer end of said second rod;

a second saddle being mounted on and threadably coupled to said second rod, said second saddle extending upwardly through said second slot, said second saddle moving toward said first side edge when said second handle is rotated in a first direction and toward said second side edge when said second handle is rotated in a second direction;

a second vertical wall being attached to said second saddle, said second vertical wall being elongated, a longitudinal axis of said second vertical wall being orientated perpendicular to said second slot.

5. The assembly according to claim 4, wherein said mounting includes a horizontally orientated plate having an upper side and a lower side, a lifting apparatus being attached to said table and supporting said plate above said table, said lifting apparatus selectively lifting or lowering said plate with respect to said table, said plate having an aperture extending therethrough, a plurality of couplers being attached to said upper side of said plate, said couplers releasably securing said router to said plate.

6. The assembly according to claim 1, wherein said mounting includes a horizontally orientated plate having an upper side and a lower side, a lifting apparatus being attached to said table and supporting said plate above said table, said lifting apparatus selectively lifting or lowering said plate with respect to said table, said plate having an aperture extending therethrough, a plurality of couplers being attached to said upper side of said plate, said couplers releasably securing said router to said plate.

7. A router guide and support assembly comprising:

a table having a top side, a bottom side, a first side edge, a second side edge, a front edge and a rear edge, a plurality of legs being attached to and extending downwardly from said bottom side, said table having a first slot and a second slot each extending therethrough, said fist slot extending between said front and rear edges and said second slot extending from said first side edge to said first slot, said first slot being spaced from said first side edge a distance equal to at least 8 inches, said second slot being generally equally spaced from each of said front and rear edges;

a first guide being attached to said table and being selectively movable along said first slot, said first guide including;

a threaded first rod being rotatably attached to said bottom side and being aligned with said first slot, said first rod having an outer end extending away from said front edge;

a first handle being attached to said outer end of said first rod;

a first saddle being mounted on and threadably coupled to said first rod, said first saddle extending upwardly through said first slot, said first saddle moving toward said front edge when said first handle is rotated in a first direction and toward said rear edge when said first handle is rotated in a second direction;

a first vertical wall being attached to said first saddle, said first vertical wall being elongated, a longitudinal axis of said first vertical wall being orientated perpendicular to said first slot;

a second guide being attached to said table and being selectively movable along said second slot, said second guide including;

a threaded second rod being rotatably attached to said bottom side and being aligned with said second slot, said second rod having an outer end extending away from said first side edge;

a second handle being attached to said outer end of said second rod;

a second saddle being mounted on and threadably coupled to said second rod, said second saddle extending upwardly through said second slot, said second saddle moving toward said first side edge when said second handle is rotated in a first direction and toward said second side edge when said second handle is rotated in a second direction;

a second vertical wall being attached to said second saddle, said second vertical wall being elongated, a longitudinal axis of said second vertical wall being orientated perpendicular to said second slot; and a mounting being attached to said table and supporting a router a selected distance from said top side of said table, said mounting being positioned adjacent to said first side edge, said mounting including a horizontally orientated plate having an upper side and a lower side, a lifting apparatus being attached to said table and supporting said plate above said table, said lifting apparatus selectively lifting or lowering said plate with respect to said table, said plate having an aperture extending therethrough, a plurality of couplers being attached to said upper side of said plate, wherein a router may be attached to said plate with said couplers such that a cutting member of said router extends through said aperture and toward said table.

8. A router guide and support assembly comprising:

a table having a top side, a bottom side, a first side edge, a second side edge, a front edge and a rear edge, a plurality of legs being attached to and extending downwardly from said bottom side, said table having a first slot and a second slot each extending therethrough, said first slot extending between said front and rear edges and said second slot extending from said first side edge to said first slot;

a first guide being attached to said table and being selectively movable along said first slot;

a second guide being attached to said table and being selectively movable along said second slot; and a mounting being attached to said table and supporting a router a selectable distance from said top side of said table, said mounting being positioned adjacent to said first side edge, wherein a router may be attached to said mounting such that a cutting member of said router extends toward said table, said mounting including:

a horizontally orientated plate having an upper side and a lower side;

a lifting apparatus being attached to said table and supporting said plate above said table, said lifting apparatus selectively lifting or lowering said plate with respect to said table, said plate having an aperture extending therethrough;

a plurality of couplers being attached to said upper side of said plate, said couplers releasably securing said router to said plate.

9. The assembly according to claim 8, wherein said first slot is spaced from said first side edge a distance equal to at least 8 inches.

10. The assembly according to claim 9, wherein said second slot is generally equally spaced from each of said front and rear edges.

11. The assembly according to claim 8, further comprising:

said first guide including;

a threaded first rod being rotatably attached to said bottom side and being aligned with said first slot said first rod having an outer end extending away from said front edge;

a first handle being attached to said outer end of said first rod;

a first saddle being mounted on and threadably coupled to said first rod, said first saddle extending upwardly through said first slot, said first saddle moving toward said front edge when said first handle is rotated in a first direction and toward said rear edge when said first handle is rotated in a second direction;

a first vertical wall being attached to said first saddle, said first vertical wall being elongated, a longitudinal axis of said first vertical wall being orientated perpendicular to said first slot;

said second guide including;

a threaded second rod being rotatably attached to said bottom side and being aligned with said second slot said second rod having an outer end extending away from said first side edge;

a second handle being attached to said outer end of said second rod;

a second saddle being mounted on and threadably coupled to said second rod, said second saddle extending upwardly through said second slot, said second saddle moving toward said first side edge when said second handle is rotated in a first direction and toward said second side edge when said second handle is rotated in a second direction; and a second vertical wall being attached to said second saddle, said second vertical wall being elongated, a longitudinal axis of said second vertical wall being orientated perpendicular to said second slot.

* * * * *